US009868141B2

(12) United States Patent
Esposito et al.

(10) Patent No.: US 9,868,141 B2
(45) Date of Patent: Jan. 16, 2018

(54) WORKPIECE-SHAPING TOOL ASSEMBLY

(71) Applicants: Michael Esposito, Dortmund (DE); Aljoscha Langenohl, Dortmund (DE)

(72) Inventors: Michael Esposito, Dortmund (DE); Aljoscha Langenohl, Dortmund (DE)

(73) Assignee: SMS MEER GMBH, Moenchengladbach (DE)

( * ) Notice: Subject to any disclaimer, the term of this patent is extended or adjusted under 35 U.S.C. 154(b) by 0 days.

(21) Appl. No.: 13/893,704

(22) Filed: May 14, 2013

(65) Prior Publication Data

US 2013/0343804 A1 Dec. 26, 2013

(30) Foreign Application Priority Data

Jun. 20, 2012 (DE) ..... 10 2012 012 293

(51) Int. Cl.
*B21B 35/14* (2006.01)
*B21B 13/00* (2006.01)

(52) U.S. Cl.
CPC ..... *B21B 35/14* (2013.01); *B21B 35/141* (2013.01); *B21B 13/005* (2013.01); *Y10T 403/18* (2015.01)

(58) Field of Classification Search
None
See application file for complete search history.

(56) References Cited

U.S. PATENT DOCUMENTS 4,576,503 A * 3/1986 Orain ..... 403/259
4,813,113 A 3/1989 Wykes et al.
5,163,816 A * 11/1992 Goetzke et al. ..... 416/204 A
5,934,131 A * 8/1999 Shen ..... B21B 27/035 72/252.5
6,526,795 B1 * 3/2003 Fabris ..... 72/249
6,599,052 B1 * 7/2003 Phillips ..... F16D 1/096 403/16
7,255,482 B2 * 8/2007 Yamamoto ..... B60B 27/00 29/256
2004/0144148 A1 7/2004 Klingen et al.
2009/0324323 A1 * 12/2009 Yamashita et al. ..... 403/16
2010/0092122 A1 * 4/2010 Fukumura et al. ..... 384/544

FOREIGN PATENT DOCUMENTS

DE 8805632.5 U1 6/1988
GB 2019528 A 4/1979
GB 2019528 A 10/1979
JP 2004034157 A 2/2004
JP H11047810 7/2014

* cited by examiner

*Primary Examiner* — Matthieu F Setliff
(74) *Attorney, Agent, or Firm* — Andrew Wilford

(57) ABSTRACT

A workpiece-shaping tool assembly has a drive shaft having an outer end centered on and rotatable about an axis and a tool fittable with the end of the drive shaft. A torque coupling is formed by shaft splines formed on the drive shaft and tool splines formed on the tool, complementary to the shaft splines, and interfitting with the shaft splines. A radial-force coupling is formed by an inner cylindrical shaft surface formed on the shaft axially offset from the shaft splines and centered on the axis and a respective inner cylindrical tool surface formed on the tool offset from the tool splines, centered on the axis, and radially juxtaposed and engageable with the inner shaft surface.

8 Claims, 1 Drawing Sheet

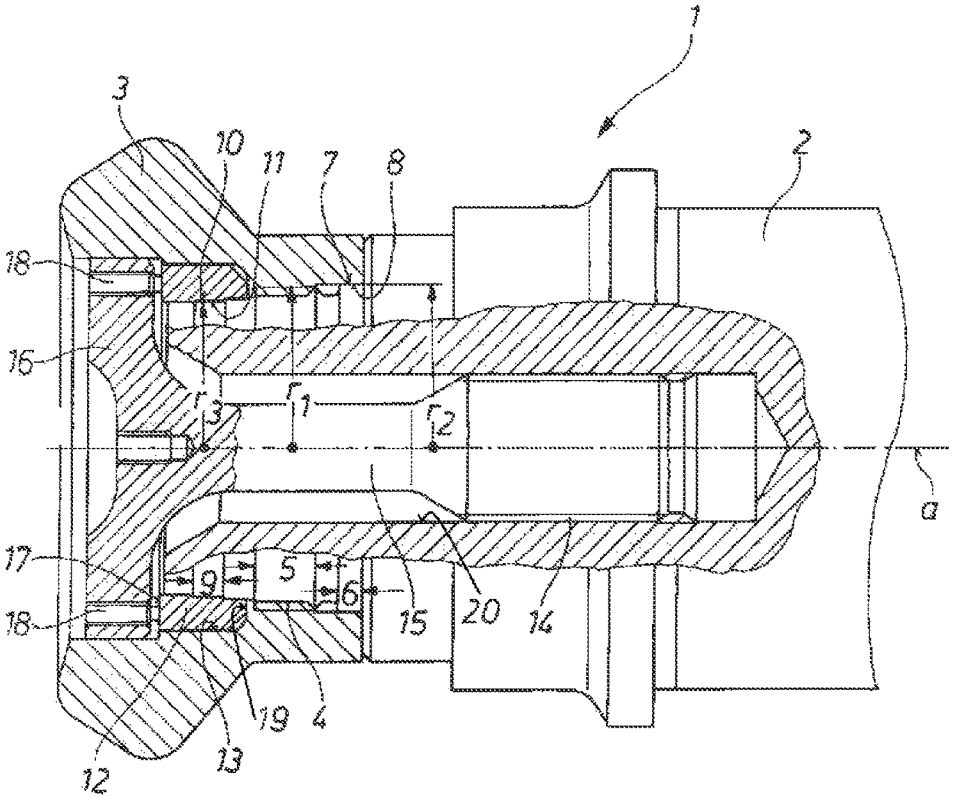
1
2
3
4
5
6
7
8
9
10
11
12
13
14
15
16
17
18
18
19
20
a
r1
r2
r3

WORKPIECE-SHAPING TOOL ASSEMBLY

FIELD OF THE INVENTION

The present invention relates to an workpiece-shaping tool assembly. More particularly this invention concerns a shaping roll.

BACKGROUND OF THE INVENTION

A typical workpiece-shaping assembly has a drive shaft centered on and rotatable about an axis and a tool, in particular, a roll, that is attached to this shaft. a keyed coupling, in particular a spline coupling, is provided between the drive shaft and the tool for transmitting torque from the drive shaft to the tool.

Assemblies of this type involve releasably securing a tool, specifically, a roll, to the drive shaft. When in use, high torque must be transmitted by the drive shaft to the roll. A known approach here is to employ a spline coupling between drive shaft and roll. Involute spline couplings of this type are fairly well known and in common use. Reference is made here to DIN 5480 and DIN 5466 that provide information on the constructive design of these structures.

The use of a spline coupling between the drive shaft and the roll advantageously achieves the result that, on the one hand, a transmission of torque is possible but, on the other hand, the spline coupling can also transmit radial forces due to its design, and this aspect is highly essential here for rolling a workpiece.

In the case of a standard forming tool, the coupling between the drive shaft and the roll is thus currently created by a spline-type coupling. The rolling forces and torques are transmitted in a small space. Great importance is furthermore attached to rapid and simple roll replacement in order to reliably ensure a high level of economic efficiency in the working process. The use of spline couplings has proven to be very successful in this regard.

A disadvantageous aspect here is however the fact that use of this coupling between a roll and a drive shaft involves a high level of wear on the coupling formations, with the result that the parts must be replaced after a certain service time so as to be able to reliably effect the transmission of radial forces and torques. This is because both radial forces as well as torques must be transmitted in a confined space and this causes corresponding problems in terms of susceptibility to wear.

OBJECTS OF THE INVENTION

It is therefore an object of the present invention to provide an improved workpiece-shaping assembly.

Another object is the provision of such an improved workpiece-shaping assembly that overcomes the above-given disadvantages, in particular that substantially reduces wear of the coupling between the drive shaft and the roll with the aim of increasing the service life for the assembly, thereby reducing costs accordingly.

SUMMARY OF THE INVENTION

A workpiece-shaping tool assembly has according to the invention a drive shaft having an outer end centered on and rotatable about an axis and a tool fittable with the end of the drive shaft. A torque coupling is formed by shaft splines formed on the drive shaft and tool splines formed on the tool, complementary to the shaft splines, and interfitting with the shaft splines. A radial-force coupling is formed by an inner cylindrical shaft surface formed on the shaft axially offset from the shaft splines and centered on the axis and a respective inner cylindrical tool surface formed on the tool offset from the tool splines, centered on the axis, and radially juxtaposed and engageable with the inner shaft surface.

This structure then takes the load of radial forces off the spline coupling so that it only has to transmit torque.

The splines here are preferably at a radius from the axis that is smaller than the radius of the inner cylindrical surfaces from the axis.

In a highly preferred approach, a second outer axial section can be provided outside the splines and outside the inner axial section, in which outer section the drive shaft and the tool have interacting outer cylindrical surfaces that are designed to transmit radial forces. Provision is preferably made here that the inner axial section is between the outer axial section and the second outer axial section. A lubricant can be advantageously introduced into the space located between the outer and inner axial sections, in which space the spline coupling is located, in order to provide an optimal delivery of lubricant to the spline coupling.

The outer cylindrical surface of the tool can be created by a ring fitted in the body of the tool. The ring here is preferably press fitted in a cylindrical counterbore of the tool. This press fit can preferably be created by shrinking.

The keyed coupling preferably has an inner radius axis that is greater than the inner radius of the outer cylindrical surfaces. This then allows for easy mounting and removal.

The keyed coupling, at least one of the inner or at least one of the outer cylindrical surfaces are advantageously provided with a wear-resistance coating.

A tension rod can be screwed into a central thread of the drive shaft so as to press against an end face of the tool with a flange so as to axially secure the tool on the drive shaft. This end face can, in particular, be the end face of the ring. A circular array of screws, in particular, headless grub screws, can be fitted in respective threaded bores in the flange. These screws can in turn press against the end face of the tool, in particular, against an end face of the ring.

The proposed embodiment of a rolling assembly for shaping a rolled product advantageously achieves the result of enabling wear of the coupling between the drive shaft and the tool to be substantially reduced. The functions of transmitting torque on the one hand and transmitting radial forces on the other hand are decoupled. Relieving radial forces enables the spline coupling to transmit even high levels of torque with substantially reduced wear.

Providing wear-resistant surface coatings and the use of optimal lubrication also contribute to the reduction in wear.

In addition, a backlash-free axial mounting is provided that similarly ensures that wear to the assembly is minimized.

The result produced is thus a significant reduction in wear, and at the same time a significant increase in the service life of the assembly or its parts.

The proposed tool is employed, in particular, in hot-forming since the referenced advantages have an especially significant effect in such an application.

The proposal according to the invention allows for a transmission of transverse radial forces through separate surfaces. Axial forces are transmitted through the tension rod (threaded bolt) isolated therefrom. However, the transmission of torque between drive shaft and roll is effected exclusively through the spline coupling, which in fact according to the invention must transmit torques exclusively and is relieved of other forces, in particular, radial forces, and this factor is results in the desired significant increase in service life.

A not insignificant aspect relates to the lubrication of the assembly. Selecting an appropriate lubricant, in particular in combination with the application of a surface coating to the regions of the assembly under high load, enables wear to be further reduced to a considerable degree.

BRIEF DESCRIPTION OF THE DRAWING

The above and other objects, features, and advantages will become more readily apparent from the following description, reference being made to the accompanying drawing whose sole FIGURE is a partly axially sectional side view of the tool assembly of this invention.

SPECIFIC DESCRIPTION OF THE INVENTION

As seen in the drawing, an assembly 1 for shaping an unillustrated workpiece or rolled product comprises a steel drive shaft 2 that is centered on and that can rotate about an axis a and that is formed with an axially centered and outwardly open bore 20. A tool 3 in the form of a roll is attached to the axial outer end of drive shaft 2. The attachment is designed to be releasable, thereby allowing the tool 3, when worn, to be removed from the drive shaft 2 and replaced by a different one.

The drive shaft 2 and tool 3 are designed so that torque can be transmitted from the drive shaft 2 to the tool 3, and radial and axial forces can be also be transmitted relative to the axis a. The couplings are designed so that torque about the axis a and radial forces can be transmitted between the drive shaft 2 and the tool 3, and also so that axial forces can be transmitted between the drive shaft 2 and the tool 3, in each case separately and isolated from each other.

Specifically, the shaft 2 and tool 3 have a keyed torque-transmitting spline coupling 4 that here extends along an inner axial section 5 whose length is sufficient to enable it to reliably transmit the required torque. According to the invention the spline coupling is completely relieved here of radial and axial forces.

Radial forces are transmitted through an inner axial section 6 and an outer axial section 9. The respective cylindrical surfaces in these two sections 6 and 9 are provided on the shaft 2 and also on the tool 3 that are toleranced to each other so as to provide a predefined transmission of radial forces.

The shaft 2 thus has in the inner axial section 6 of the bore 20 an outwardly facing cylindrical surface 7 that interacts with a complementary inwardly facing cylindrical surface 8 of the tool 3. In the outer axial section 9 of the bore 20, however, the shaft 2 has an outwardly directed cylindrical surface 10 that interacts with a complementary inwardly directed surface 11 of the tool 3.

It is evident in the outer axial section 9 that the outer but inwardly directed cylindrical surface 11 is formed on a ring 12 that is inserted into a cylindrical counterbore 13 in the main body of the roll 2, and that bears axially inward on a shoulder 19 formed at the inner end of the counterbore 13. This ring 12 is secured in the cylindrical counterbore 13 by a thermal shrinking process, that is it is made to be an exact and very tight fit, then is chilled and fitted to the counterbore 13 against the shoulder 19 so that when it warms up and expands it is locked in the body of the tool 3. Thus the ring 12 is not unitary with the main body of the tool 3, but is integral therewith as a result of the tight surface contact.

The transmission of axial forces is effected exclusively and in a manner isolated from the transmission of torque and from the transmission of radial forces by a tension rod 15 that is secured in the bore 20 inward of the region 6 by inner and outer complementary screwthreads 14 of the shaft 2 and the rod 15. This tension rod 15 has at its outer end an integral flange disk 16 that bears on an end face 17 of the tool 3. This end face 17 is actually the planar and annular outer end face of the ring 12.

In order to provide backlash-free axial attachment of the tool 3 on the shaft 2, the flange 16 is formed around its circumference with an annular array of axially extending and angularly equispaced threaded holes into which headless grub screws 18 are engaged. These screws 18 are tightened until their one axial ends contact the end face of ring 12 with sufficient initial tension, so that in practice the flange 16 does not bear directly on the end face 17, but via the screws 18 thereon.

An inner radius $r_1$ of the splines of the body 3 in the region 5 is smaller than the radius $r_2$ of the cylindrical inner surfaces 7 and 8 in the inner section 6.

Radius $r_1$ of the spline coupling 4 is, however, greater than a radius $r_3$ of the cylindrical outer surfaces 10, 11 in outer section 9. Thus $r_3<r_1$, $r_2$.

The shrinking-in of the ring 12 provides a trouble-free approach for machining the teeth of the spline coupling 4 in the tool 3. Specifically, this profile can be produced, for example by milling and/or grinding, before fitting in the shrink-fit ring 12, since without the ring 12 clearance is provided for the tool required for this purpose to pass axially through the roll tool 3. It is only after this that ring 12 is shrunk and inserted and the tool 3 is thereby completed.

All of the surfaces that are under load when the assembly 1 is operating can be coated, thereby ensuring an extended service life. A lubricant can be introduced between the regions 6 and 9 and along the splines 4 to allow the spline coupling to operate optimally.

We claim:

1. A workpiece-shaping tool assembly, the assembly comprising:

a drive shaft having an outer end centered on and rotatable about an axis;

a tool body fittable with the end of the drive shaft;

a ring shrink-fitted in the end of the tool body;

a torque coupling formed by shaft splines formed axially inward of the ring on the drive shaft and tool splines formed on the tool body, complementary to the shaft splines, and interfitting radially with the shaft splines;

a radial-force coupling formed by axially spaced inner and outer cylindrical shaft surfaces on the drive shaft, axially flanking the torque coupling, and centered on the axis and complementary respective axially spaced inner and outer cylindrical tool surfaces respectively formed on the tool body and ring, axially flanking the torque coupling, centered on the axis, and radially juxtaposed and bearing radially directly on the respective inner and outer shaft surfaces; and a tension rod having an inner end threadedly received in the shaft axially inward of the inner and outer shaft and tool surfaces and an outer end bearing axially on an annular end face of the ring and through the ring on the tool body.

2. The shaping assembly defined in claim 1, wherein the cylindrical inner and outer tool surfaces are directed radially inward and the cylindrical inner and outer shaft surfaces are directed radially outward.

3. The shaping assembly defined in claim 1, wherein the tool splines are of smaller inside diameter than the inner shaft surface.

4. The shaping assembly defined in claim 1, wherein the tool body is formed with a bore in which the inner tool surface and the tool splines are formed and with a counterbore at an outer end of the bore and in which the ring formed with the outer tool surface is fitted.

5. The shaping assembly defined in claim 4 wherein the bore and counter bore form an axially outwardly directed annular shoulder face against which the ring bears axially inward.

6. The shaping assembly defined in claim 1, wherein the outer end of the tension rod is formed as a radially projecting flange formed with an annular array of axially throughgoing threaded bores, the assembly further comprising:

respective screws threaded in the throughgoing bores and bearing axially on the ring.

7. The shaping assembly defined in claim 6, wherein the shaft is formed with an axially outwardly open bore in which is formed inward of the splines a screwthread threadedly engaged with the tension rod, the screws bearing axially inward on the ring.

8. The shaping assembly defined in claim 1, wherein the annular end face of the ring is centered on the axis and the tension rod extends along and is centered on the axis.

* * * * *